US008167536B2

(12) United States Patent
Liang

(10) Patent No.: US 8,167,536 B2
(45) Date of Patent: May 1, 2012

(54) TURBINE BLADE LEADING EDGE TIP COOLING SYSTEM

(75) Inventor: George Liang, Palm City, FL (US)

(73) Assignee: Siemens Energy, Inc., Orlando, FL (US)

( * ) Notice: Subject to any disclaimer, the term of this patent is extended or adjusted under 35 U.S.C. 154(b) by 571 days.

(21) Appl. No.: 12/397,805

(22) Filed: Mar. 4, 2009

(65) Prior Publication Data

US 2010/0226790 A1 Sep. 9, 2010

(51) Int. Cl.
*F03B 11/00* (2006.01)
*F01D 5/08* (2006.01)

(52) U.S. Cl. ..... 415/115; 416/97 R

(58) Field of Classification Search ..... 415/115; 416/97 R

See application file for complete search history.

(56) References Cited

U.S. PATENT DOCUMENTS

| | | | | |
|---|---|---|---|---|
| 4,500,258 | A | 2/1985 | Dodd et al. | |
| 4,761,116 | A * | 8/1988 | Braddy et al. | 416/92 |
| 5,462,405 | A | 10/1995 | Hoff et al. | |
| 6,183,199 | B1 | 2/2001 | Beeck et al. | |
| 7,175,386 | B2 | 2/2007 | Cherolis et al. | |
| 7,195,458 | B2 | 3/2007 | Liang | |
| 7,296,973 | B2 | 11/2007 | Lee et al. | |
| 7,303,376 | B2 | 12/2007 | Liang | |
| 7,320,575 | B2 | 1/2008 | Wadia et al. | |
| 7,374,401 | B2 | 5/2008 | Lee | |
| 7,377,743 | B2 | 5/2008 | Flodman et al. | |
| 7,399,160 | B2 | 7/2008 | Harvey et al. | |
| 2006/0073015 | A1 | 4/2006 | Liang | |
| 2007/0177976 | A1 | 8/2007 | Cunha et al. | |
| 2007/0237637 | A1 | 10/2007 | Lee et al. | |

FOREIGN PATENT DOCUMENTS

| | | |
|---|---|---|
| JP | 02-011801 | 1/1990 |

* cited by examiner

*Primary Examiner* — Michelle Mandala

(57) ABSTRACT

A turbine blade for a turbine engine having a cooling system in the turbine blade formed from at least one leading edge cooling chamber for cooling the leading edge and for exhausting cooling fluids through a tip exhaust outlet. The leading edge cooling channel may include a second section that extends radially inward from the tip exhaust outlet and a first section that extends radially inward from the second section along the leading edge. The second section may be narrower than the first section and may direct cooling fluids to be exhausted from tip exhaust outlet skewed angle towards the suction side of the blade. As such, the leading edge cooling channel and tip exhaust outlet cooperate to exhaust the cooling fluids without forming a separation zone at the upstream side of the intersection between the leading edge cooling channel and the tip exhaust outlet.

20 Claims, 5 Drawing Sheets

TURBINE BLADE LEADING EDGE TIP COOLING SYSTEM

FIELD OF THE INVENTION

This invention is directed generally to turbine blades, and more particularly to cooling systems in hollow turbine blades.

BACKGROUND

Typically, gas turbine engines include a compressor for compressing air, a combustor for mixing the compressed air with fuel and igniting the mixture, and a turbine blade assembly for producing power. Combustors often operate at high temperatures that may exceed 2,500 degrees Fahrenheit. Typical turbine combustor configurations expose turbine blade assemblies to these high temperatures. As a result, turbine blades must be made of materials capable of withstanding such high temperatures. In addition, turbine blades often contain cooling systems for prolonging the life of the blades and reducing the likelihood of failure as a result of excessive temperatures.

Typically, turbine blades are formed from a root portion at one end and an elongated portion forming a blade that extends outwardly from a platform coupled to the root portion at an opposite end of the turbine blade. The blade is ordinarily composed of a tip opposite the root section, a leading edge, and a trailing edge. The inner aspects of most turbine blades typically contain an intricate maze of cooling channels forming a cooling system. The cooling channels in the blades receive air from the compressor of the turbine engine and pass the air through the blade. The cooling channels often include multiple flow paths that are designed to maintain all aspects of the turbine blade at a relatively uniform temperature. However, centrifugal forces and air flow at boundary layers often prevent some areas of the turbine blade from being adequately cooled, which results in the formation of localized hot spots. Localized hot spots, depending on their location, can reduce the useful life of a turbine blade and can damage a turbine blade to an extent necessitating replacement of the blade. Often times, localized hot spots form in the tip section of turbine blades. As shown in FIGS. 1 and 2, a separation zone may form on the upstream side of the blade and in internal aspects of the cooling system at a conventional squealer tip. The separation zone creates temperature overages in the cooling system and more specifically, at the airfoil tip. Thus, a need exists for removing excessive heat in the tip section of turbine blades.

SUMMARY OF THE INVENTION

This invention relates to a turbine blade cooling system for a turbine blade used in turbine engines. In particular, the turbine blade cooling system may be directed to a cooling system located in a cavity positioned between two or more walls forming a housing of the turbine blade. The cooling system may include one or more leading edge cooling chambers for cooling the leading edge and for exhausting cooling fluids through a tip exhaust outlet. Portions of the leading edge cooling channel proximate to the tip exhaust outlet may be narrower than the radially inward sections of the leading edge cooling channel and may direct cooling fluids to be exhausted from tip exhaust outlet at skewed angles towards the suction side of the blade. As such, the leading edge cooling channel and tip exhaust outlet cooperate to exhaust the cooling fluids from the blade without forming a separation zone at the upstream side of the intersection between the leading edge cooling channel and the tip exhaust outlet.

The turbine blade may be formed from a generally elongated blade having a leading edge, a trailing edge, a tip section at a first end, a root coupled to the blade at an end generally opposite the first end for supporting the blade and for coupling the blade to a disc, and at least one cavity forming a cooling system in the blade. The cooling system may have any appropriate configuration. In one embodiment, the cooling system may include a leading edge cooling channel and a triple pass serpentine cooling channel extending from proximate the leading edge cooling channel to the trailing edge. The turbine blade may be formed from an outer wall forming a pressure side and suction side that is generally opposite to the pressure side. The pressure and suction sides may be coupled together with the leading and trailing edges. The pressure and suction sides at the tip section may be separated from each other by an outer tip surface having a generally concave shape forming a squealer tip. A tip exhaust outlet may be positioned proximate to a intersection between the tip section and the leading edge. In one embodiment, the tip exhaust outlet may be in contact with the outer wall forming the suction side, and a downstream side of the tip exhaust outlet may be positioned generally at a midpoint between the leading and trailing edges. At least a portion of the cooling system may exhaust cooling fluids from the tip exhaust outlet after passing through the leading edge cooling channel. The leading edge cooling channel in communication with the tip exhaust outlet may be curved proximate to the tip exhaust outlet such that an axis aligned with the cooling fluid flow at the tip exhaust outlet may be skewed towards the suction side of the blade to exhaust cooling fluids into the hot gas path to prevent formation of an efficiency destroying fluid separation zone.

The cooling system of the blade may include a leading edge cooling channel in communication with the tip exhaust outlet. The cooling channel may have a first section with generally linear side walls formed by the outerwalls forming the pressure and suction sides and may have a second section between the first section and the tip exhaust outlet that is formed by a generally convex shaped surface on the suction sidewall and a generally concave shaped surface on the pressure sidewall. The second section may have a cross-sectional area that is less than a cross-sectional area of the first section, which increases the velocity of the cooling fluids in the second section. In another embodiment, a longitudinal axis of the leading edge cooling channel may change direction twice in the second section of the leading edge cooling channel. In particular, the longitudinal axis of the leading edge cooling channel may be generally aligned with the pressure and suction sidewalls of the first section. When moving radially outwardly, the longitudinal axis may be skewed toward the pressure side between the intersection of the first and second sections and a point radially outward of the intersection. The longitudinal axis may then be skewed toward the suction side between the point radially outward of the intersection and the tip exhaust outlet.

An advantage of this invention is that the tip exhaust outlet and the leading edge cooling channel form a tip cooling and sealing device void of internal flow separation at the upstream side of the tip exhaust outlet, thereby eliminating over temperatures.

Another advantage of this invention is that the leading edge cooling channel immediately proximate to the tip exhaust outlet is skewed towards the suction side to prevent an internal separation zone from forming.

These and other embodiments are described in more detail below.

BRIEF DESCRIPTION OF THE DRAWINGS

The accompanying drawings, which are incorporated in and form a part of the specification, illustrate embodiments of the presently disclosed invention and, together with the description, disclose the principles of the invention.

DETAILED DESCRIPTION OF THE INVENTION

Figure 1:
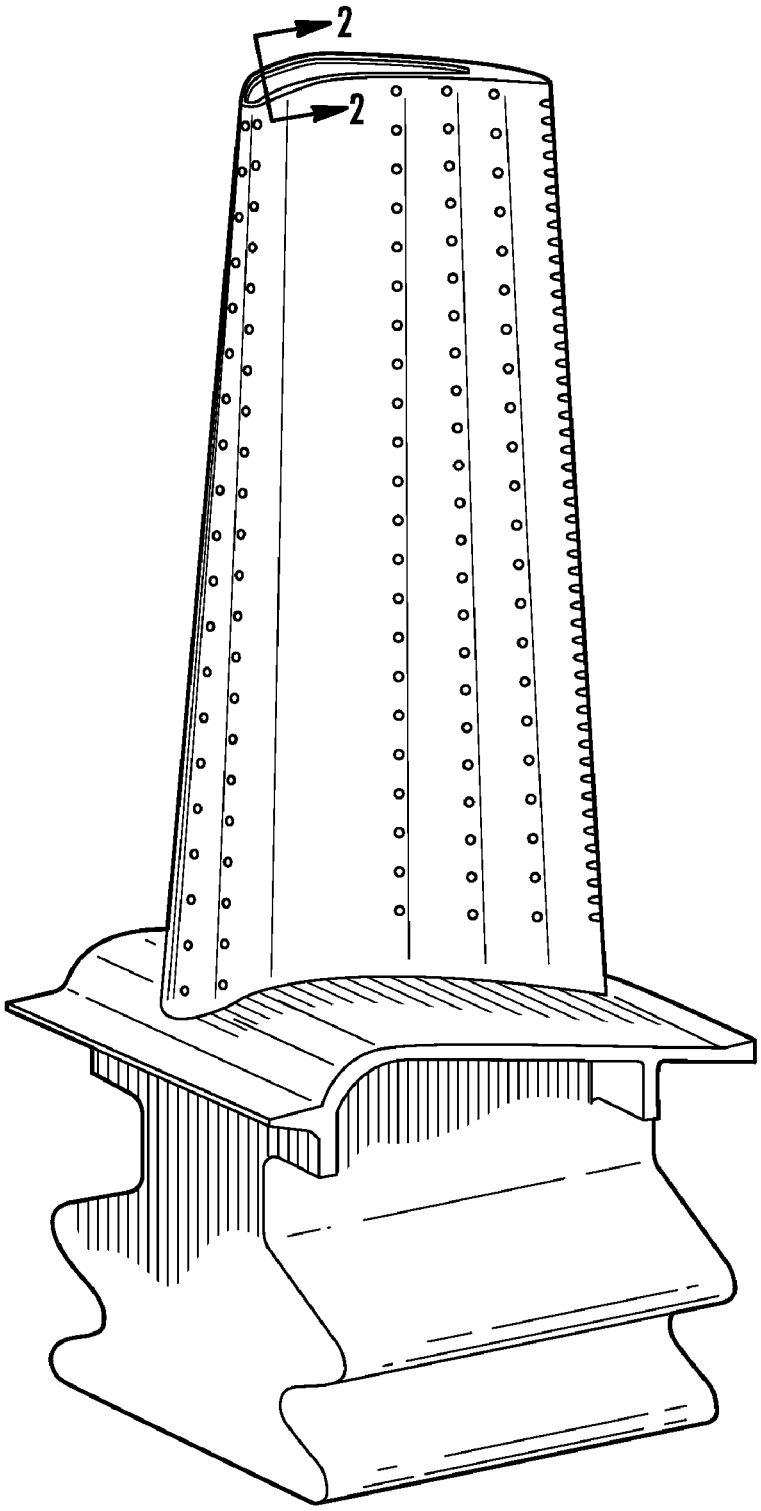
FIG. 1 PRIOR ART
FIG. 1 is a perspective view of a conventional turbine blade.
Figure 2:
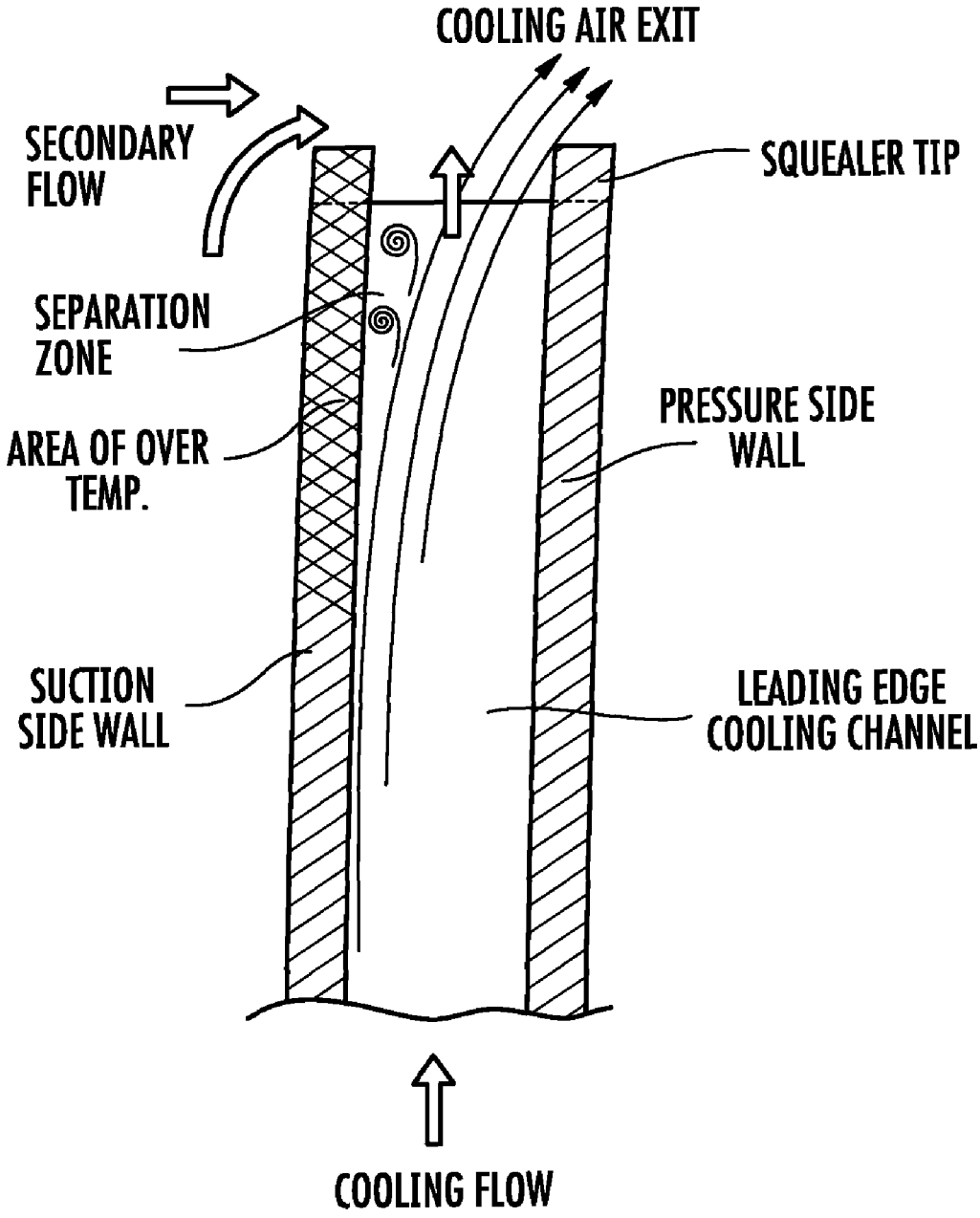
FIG. 2 PRIOR ART
FIG. 2 is a cross-sectional detailed view of a tip section of a conventional turbine blade of the prior art taken along section line 2-2.
Figure 3:
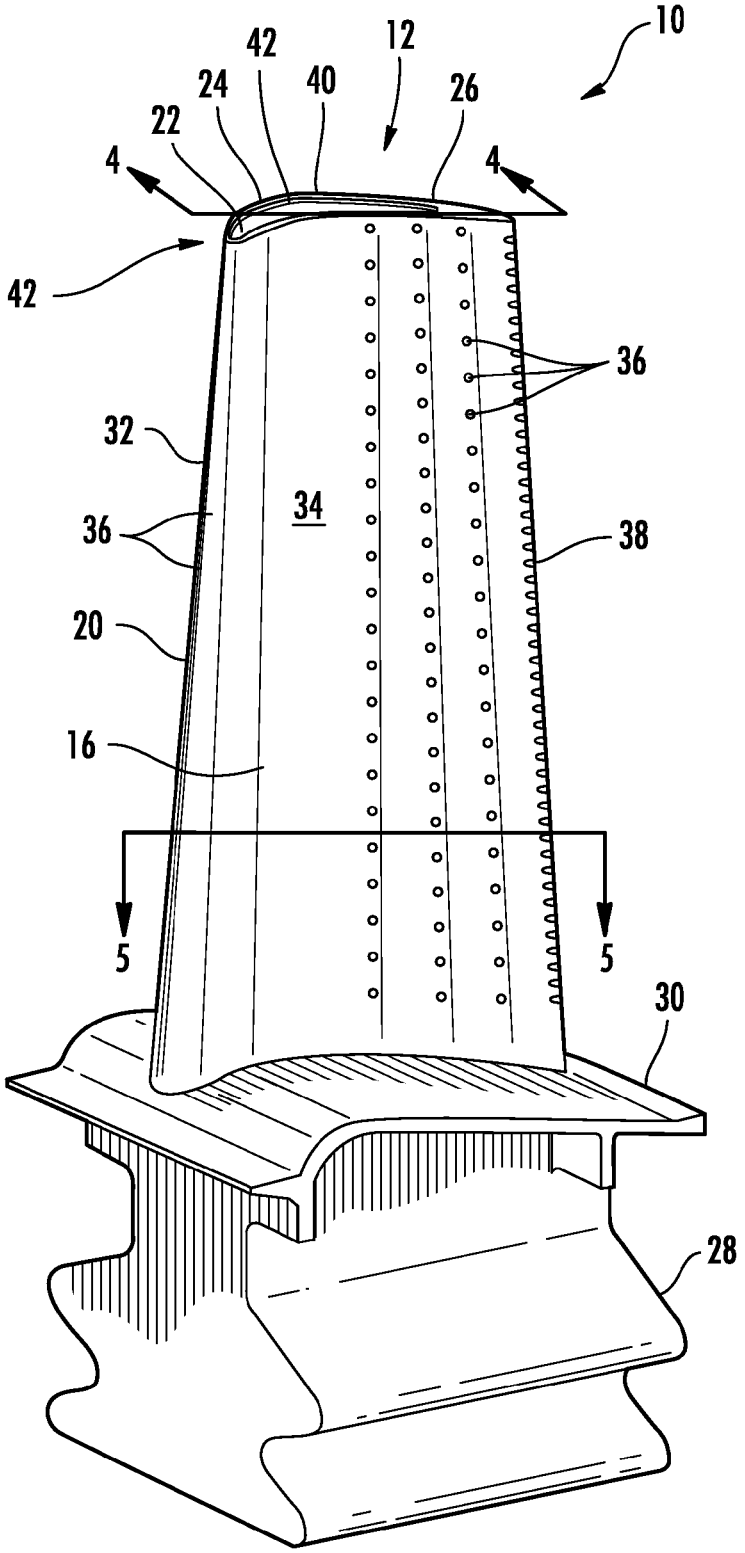
FIG. 3 is a perspective view of a turbine blade having features according to the instant invention.
Figure 4:
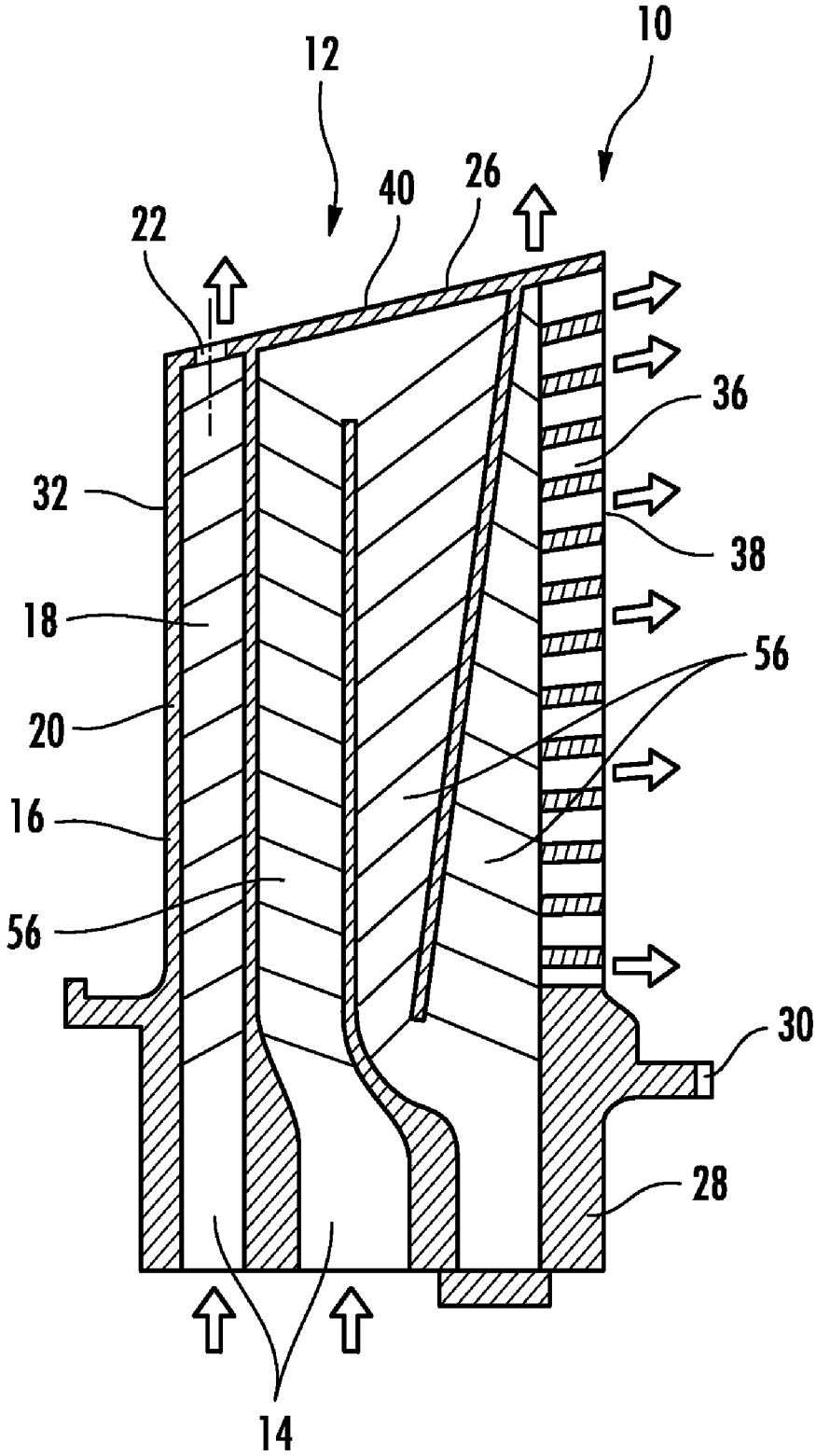
FIG. 4 is cross-sectional view, referred to as a filleted view, of the turbine blade shown in FIG. 3 taken along line 4-4.
Figure 5:
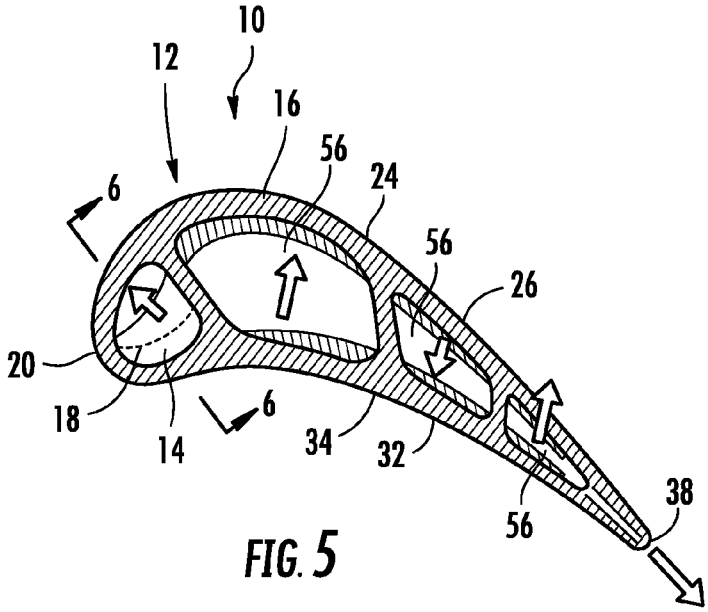
FIG. 5 is a cross-sectional view of the turbine blade shown in FIG. 3 taken along line 5-5.
Figure 6:
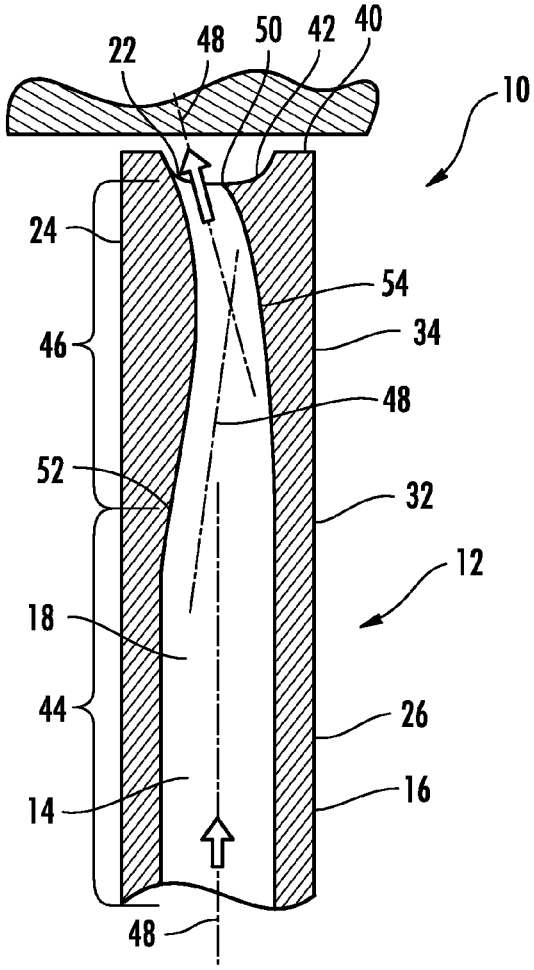
FIG. 6 is a partial cross-sectional view of a tip section of the turbine blade shown in FIG. 5 taken along line 6-6.

As shown in FIGS. 3-6, this invention is directed to a turbine blade cooling system 10 for a turbine blade 12 used in turbine engines. In particular, the turbine blade cooling system 10 may be directed to a cooling system 10 located in a cavity 14, as shown in FIGS. 4-6, positioned between two or more walls forming a housing 16 of the turbine blade 12. The cooling system 10 may include one or more leading edge cooling chambers 18 for cooling the leading edge 20 and for exhausting cooling fluids through a tip exhaust outlet 22. Portions of the leading edge cooling channel 18 proximate to the tip exhaust outlet may be narrower than the radially inward sections of the leading edge cooling channel 18 and may direct cooling fluids to be exhausted from tip exhaust outlet 22 at skewed angles towards the suction side 24 of the blade 12. As such, the leading edge cooling channel 18 and tip exhaust outlet 22 cooperate to exhaust the cooling fluids from the blade 12 without forming a separation zone at the upstream side of the intersection between the leading edge cooling channel 18 and the tip exhaust outlet 22.

As shown in FIG. 3, the turbine blade 12 may be formed from a generally elongated blade 26 coupled to a root 28 at a platform 30. The elongated blade 26 may have an outer wall 32 adapted for use, for example, in a first stage of an axial flow turbine engine. Outer wall 32 may form a generally concave shaped portion forming a pressure side 34 and may have a generally convex shaped portion forming the suction side 24. The cavity 14 forming the cooling system 10, as shown in FIGS. 4-6, may be positioned in inner aspects of the blade 26 for directing one or more gases, which may include air received from a compressor (not shown), through the blade 26 and out one or more orifices 36 in the blade 26 to reduce the temperature of the blade 26. As shown in FIG. 3, the orifices 36 may be positioned on a trailing edge 38 or at other locations and have various configurations. The cavity 14 may be arranged in various configurations and is not limited to a particular flow path. In one embodiment, the cooling system 10 may be formed from a triple pass serpentine cooling channel 56 extending from proximate the leading edge cooling channel 18 to the trailing edge 38.

In at least one embodiment, the cooling system 10 may include a leading edge cooling channel 18 positioned along the leading edge 20. The leading edge cooling channel 18 may extend from the root 28 to the tip 40 of the elongated blade 26. In other embodiments, the leading edge cooling channel 18 may have a shorter length. The leading edge cooling channel 18 may intersect with the tip exhaust outlet 22 at an outer tip surface 42 forming the tip 40. In at least one embodiment, as shown in FIG. 6, the pressure and suction sides 34, 24 at the tip section 40 may be separated from each other by the outer tip surface 42 that has a generally concave shape forming a squealer tip.

The leading edge cooling channel 18 may be in communication with the tip exhaust outlet 22 and may be curved proximate to the tip exhaust outlet 22 such that an axis 48 aligned with the cooling fluid flow at the tip exhaust outlet 22 is skewed towards the suction side 24 of the blade 12. In one embodiment, the leading edge cooling channel 18 may be formed from a first section 44 formed by the outerwalls 32 forming the pressure and suction sides 34, 24 and a second section 46 between the first section 44 and the tip exhaust outlet 22. In at least one embodiment, the first section 44 may be formed from generally linear side walls formed by the outerwalls 32 forming the pressure and suction sides 34, 24. The second section 46 may curved proximate to the tip exhaust outlet 22 such that the axis 48 aligned with the cooling fluid flow at the tip exhaust outlet 22 is skewed towards the suction side 24 of the blade 12. In one embodiment, the second section 46 may be formed by a generally convex shaped surface on the suction sidewall 24 and a generally concave shaped surface on the pressure sidewall 34. The second section 46 may have a cross-sectional area that is less than a cross-sectional area of the first section 44, which increases the velocity of the cooling fluids flowing through the second section 46. The second section 46 may also be configured such that the tip exhaust outlet 22 is in contact with the outer wall 32 forming the suction side 24, and a downstream side of the tip exhaust outlet 22 may be positioned generally at a midpoint 50 between the leading and trailing edges 20, 38.

In another embodiment, as shown in FIG. 6, a longitudinal axis of the leading edge cooling channel 18 changes direction twice in the second section 46 of the leading edge cooling channel 18. In particular, the longitudinal axis 48 of the leading edge cooling channel 18 may be generally aligned with the pressure and suction sidewalls 34, 24 of the first section 44. The longitudinal axis 48 may be skewed toward the pressure side 34 between the intersection 52 of the first and second sections 44, 46 and a point 54 radially outward of the intersection 52. The longitudinal axis 48 may then be skewed toward the suction side 24 between the point 54 radially outward of the intersection 52 and the tip exhaust outlet 22. In such a configuration, the exhausted cooling fluids prevent the formation of fluid separation at the upstream side of the tip exhaust outlet 22.

During use, cooling fluids enter the cooling system 10 through chambers in the root 28 of the elongated airfoil 26. At least a portion of the cooling fluids are directed into the leading edge cooling channel 18. A portion of those cooling fluids may then be exhausted through orifices 36 and the remaining cooling fluids may be passed through the first and second sections 44, 46. As the cooling fluids enter the second section proximate to the tip 40, the velocity of the cooling fluids may increase. The direction of the cooling fluid flow may change and may be skewed relative to the longitudinal axis 48 in the first section 44 and toward the suction side 24 to prevent a separation zone from forming within the leading edge cooling channel 18 at the intersection of the leading edge cooling channel 18 and the tip exhaust outlet 22. By preventing the internal flow separation and formation of the separation zone, the cooling system 10 is able to operate more efficiently than conventional systems.

The foregoing is provided for purposes of illustrating, explaining, and describing embodiments of this invention. Modifications and adaptations to these embodiments will be apparent to those skilled in the art and may be made without departing from the scope or spirit of this invention.

I claim:

1. A turbine blade, comprising:

a generally elongated blade having a leading edge, a trailing edge, a tip section at a first end, a root coupled to the blade at an end generally opposite the first end for supporting the blade and for coupling the blade to a disc, and at least one cavity forming a cooling system in the blade;

an outer wall forming a pressure side and suction side that is generally opposite to the pressure side, wherein the pressure and suction sides are coupled together with the leading and trailing edges; and a tip exhaust outlet positioned proximate to a intersection between the tip section and the leading edge, wherein at least a portion of the cooling system exhausts cooling fluids from tip exhaust outlet; and a channel positioned within the generally elongated blade and in communication with the tip exhaust outlet, wherein the channel is curved proximate to the tip exhaust outlet such that an axis aligned with the cooling fluid flow in the channel within the generally elongated blade at the tip exhaust outlet is skewed towards the suction side of the blade.

2. The turbine blade of claim 1, wherein the pressure and suction sides at the tip section are separated from each other by an outer tip surface having a generally concave shape forming a squealer tip.

3. The turbine blade of claim 1, wherein the tip exhaust outlet is in contact with the outer wall forming the suction side and a downstream side of the tip exhaust outlet is positioned generally at a midpoint between the leading and trailing edges.

4. The turbine blade of claim 1, wherein the cooling system of the blade includes a leading edge cooling channel in communication with the tip exhaust outlet, wherein the cooling channel has a first section with generally linear side walls formed by the outerwalls forming the pressure and suction sides and a second section between the first section and the tip exhaust outlet that is formed by a generally convex shaped surface on the suction sidewall and a generally concave shaped surface on the pressure sidewall.

5. The turbine blade of claim 4, wherein the cooling system further includes a triple pass serpentine cooling channel extending from proximate the leading edge cooling channel to the trailing edge.

6. The turbine blade of claim 4, wherein the second section has a cross-sectional area that is less than a cross-sectional area of the first section.

7. The turbine blade of claim 4, wherein a longitudinal axis of the leading edge cooling channel changes direction twice in the second section of the leading edge cooling channel.

8. The turbine blade of claim 7, wherein the longitudinal axis of the leading edge cooling channel is generally aligned with the pressure and suction sidewalls of the first section, the longitudinal axis is skewed toward the pressure side between the intersection of the first and second sections and a point radially outward of the intersection, and the longitudinal axis is skewed toward the suction side between the point radially outward of the intersection and the tip exhaust outlet.

9. A turbine blade, comprising:

a generally elongated blade having a leading edge, a trailing edge, a tip section at a first end, a root coupled to the blade at an end generally opposite the first end for supporting the blade and for coupling the blade to a disc, and at least one cavity forming a cooling system in the blade;

an outer wall forming a pressure side and suction side that is generally opposite to the pressure side, wherein the pressure and suction sides are coupled together with the leading and trailing edges;

a tip exhaust outlet positioned proximate to a intersection between the tip section and the leading edge, wherein at least a portion of the cooling system exhausts cooling fluids from tip exhaust outlet;

a channel positioned within the generally elongated blade and in communication with the tip exhaust outlet, wherein the channel is curved proximate to the tip exhaust outlet such that an axis aligned with the cooling fluid flow in the channel within the generally elongated blade at the tip exhaust outlet is skewed towards the suction side of the blade; and wherein the pressure and suction sides at the tip section are separated from each other by an outer tip surface having a generally concave shape forming a squealer tip.

10. The turbine blade of claim 9, wherein the tip exhaust outlet is in contact with the outer wall forming the suction side and a downstream side of the tip exhaust outlet is positioned generally at a midpoint between the leading and trailing edges.

11. The turbine blade of claim 9, wherein the cooling system of the blade includes a leading edge cooling channel in communication with the tip exhaust outlet, wherein the cooling channel has a first section with generally linear side walls formed by the outerwalls forming the pressure and suction sides and a second section between the first section and the tip exhaust outlet that is formed by a generally convex shaped surface on the suction sidewall and a generally concave shaped surface on the pressure sidewall.

12. The turbine blade of claim 11, wherein the cooling system further includes a triple pass serpentine cooling channel extending from proximate the leading edge cooling channel to the trailing edge.

13. The turbine blade of claim 11, wherein the second section has a cross-sectional area that is less than a cross-sectional area of the first section.

14. The turbine blade of claim 11, wherein a longitudinal axis of the leading edge cooling channel changes direction twice in the second section of the leading edge cooling channel.

15. The turbine blade of claim 7, wherein the longitudinal axis of the leading edge cooling channel is generally aligned with the pressure and suction sidewalls of the first section, the longitudinal axis is skewed toward the pressure side between the intersection of the first and second sections and a point radially outward of the intersection, and the longitudinal axis is skewed toward the suction side between the point radially outward of the intersection and the tip exhaust outlet.

16. A turbine blade, comprising:

a generally elongated blade having a leading edge, a trailing edge, a tip section at a first end, a root coupled to the blade at an end generally opposite the first end for supporting the blade and for coupling the blade to a disc, and at least one cavity forming a cooling system in the blade;

an outer wall forming a pressure side and suction side that is generally opposite to the pressure side, wherein the pressure and suction sides are coupled together with the leading and trailing edges;

a tip exhaust outlet positioned proximate to a intersection between the tip section and the leading edge, wherein at least a portion of the cooling system exhausts cooling fluids from tip exhaust outlet;

a channel positioned within the generally elongated blade and in communication with the tip exhaust outlet, wherein the channel is curved proximate to the tip exhaust outlet such that an axis aligned with the cooling fluid flow in the channel within the generally elongated blade at the tip exhaust outlet is skewed towards the suction side of the blade;

wherein the pressure and suction sides at the tip section are separated from each other by an outer tip surface having a generally concave shape forming a squealer tip;

wherein the cooling system of the blade includes a leading edge cooling channel in communication with the tip exhaust outlet, wherein the cooling channel has a first section with generally linear side walls formed by the outerwalls forming the pressure and suction sides and a second section between the first section and the tip exhaust outlet that is formed by a generally convex shaped surface on the suction sidewall and a generally concave shaped surface on the pressure sidewall; and wherein the second section has a cross-sectional area that is less than a cross-sectional area of the first section.

17. The turbine blade of claim 16, wherein the tip exhaust outlet is in contact with the outer wall forming the suction side and a downstream side of the tip exhaust outlet is positioned generally at a midpoint between the leading and trailing edges.

18. The turbine blade of claim 16, wherein the cooling system further includes a triple pass serpentine cooling channel extending from proximate the leading edge cooling channel to the trailing edge.

19. The turbine blade of claim 16, wherein a longitudinal axis of the leading edge cooling channel changes direction twice in the second section of the leading edge cooling channel.

20. The turbine blade of claim 16, wherein the longitudinal axis of the leading edge cooling channel is generally aligned with the pressure and suction sidewalls of the first section, the longitudinal axis is skewed toward the pressure side between the intersection of the first and second sections and a point radially outward of the intersection, and the longitudinal axis is skewed toward the suction side between the point radially outward of the intersection and the tip exhaust outlet.

* * * * *